United States Patent [19]

Tack, Jr.

[11] Patent Number: 4,942,946

[45] Date of Patent: Jul. 24, 1990

[54] BOTTOM ROD SAFETY GUARD FOR RAILWAY BRAKE RIGGING

[75] Inventor: Carl E. Tack, Jr., Carol Stream, Ill.

[73] Assignee: TransDyne, Inc., Chicago, Ill.

[21] Appl. No.: 325,383

[22] Filed: Mar. 17, 1989

[51] Int. Cl.[5] ..... B61H 13/34; B61H 16/38

[52] U.S. Cl. ..... 188/210

[58] Field of Search ..... 188/210, 206 R, 207; 248/60, 322; 24/115 H

[56] References Cited

U.S. PATENT DOCUMENTS

| | | | |
|---|---|---|---|
| 1,841,600 | 1/1932 | Haskell | 188/210 |
| 2,077,547 | 4/1973 | Busse | 188/210 |
| 3,092,213 | 6/1963 | Nelson | 188/210 |
| 3,703,225 | 11/1972 | Spaeth | 188/210 |
| 4,135,608 | 1/1979 | Adler | 188/210 |
| 4,195,715 | 4/1980 | Nadherny | 188/210 |
| 4,630,715 | 12/1986 | Adler | 188/210 |
| 4,714,218 | 12/1987 | Hungerford, Jr. | 248/60 X |

*Primary Examiner*—George E. A. Halvosa

*Attorney, Agent, or Firm*—Juettner Pyle Lloyd & Verbeck

[57] ABSTRACT

A bottom rod safety guard in the form of a loop is suspended from a brake beam. The cable ends are looped through holes in the beam, and a latch plate extends beneath the beam to provide a releaseable connection.

2 Claims, 2 Drawing Sheets

BOTTOM ROD SAFETY GUARD FOR RAILWAY BRAKE RIGGING

Background of the Invention

This invention relates to railway vehicles and more particularly to a safety device to prevent an operating rod of the brake rigging from falling downward toward the tracks in the event of a failure.

Numerous proposals have been made to provide a loop of a solid or flexible material beneath brake rods which may become disconnected or broken. Most prior art devices require the attachment of the safety guard by bolting or welding of the guard to the brake beam, which is a time consuming procedure. In U.S. Pat. No. 4,630,715, two brackets are situated on top of the brake beam. A flexible cable is employed having two strands at each end, which are looped around the beam and releaseably connected to a bracket. Other bottom rod safety guards employing flexible cables are shown in U.S. Pat. Nos. 1,841,600, 4,135,608 and 4,195,715.

The configuration shown in U.S. Pat. No. 4,630,715 has been successfully employed but is not suitable for applications in which the power cylinder is carried by the brake beam, as shown in U.S. Pat. No. 4,135,608. Such beams have a larger cross section or other structure which make it impractical to wrap a strand around the beam.

Summary of the Invention

In accordance with the present invention, a slotted connector plate similar to that shown in U.S. Pat. No. 4,630,715 is employed. In the present invention, a single strand cable is employed, and each end is passed through an opening in one end of a connector plate, and then through an existing bolt opening in the side wall of the brake beam. The cable then passes downwardly to a second opening in the other end of the connector plate. The second opening is a slot with an enlarged portion to releaseably receive an enlarged terminus on the end of the cable, and no other installation procedures are required. The resilience of the cable causes the free end of cable to be urged toward the narrow end of the slot in latching engagement to prevent disengagement of the cable during service, with the connector being situated across the width of the bottom of the brake beam.

The Drawing

Description of the Preferred Embodiment

Figure 1:
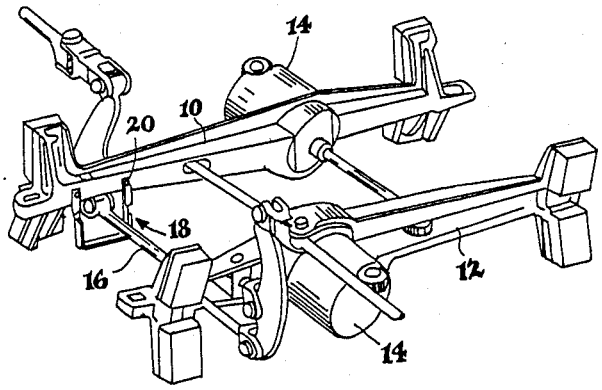
FIG. 1 is a perspective view of a railway brake system and bottom rod safety guard known in the prior art.

With reference first to FIG. 1, which shows a prior art construction, one type of railway brake rigging comprises a pair of brake beams 10 and 12, each of which carry power cylinders 14. The rigging includes an associated rod 16 extending beneath the beams. The rod 16 is typically provided with a safety guard, which is the form of a U-shaped rigid member 18 with apertured upper ends for receiving bolts 20 that extend through the beam. The purpose of the safety guard 18 is to provide support for the rod 16 in the event the rod becomes broken or disconnected.

Figure 2:
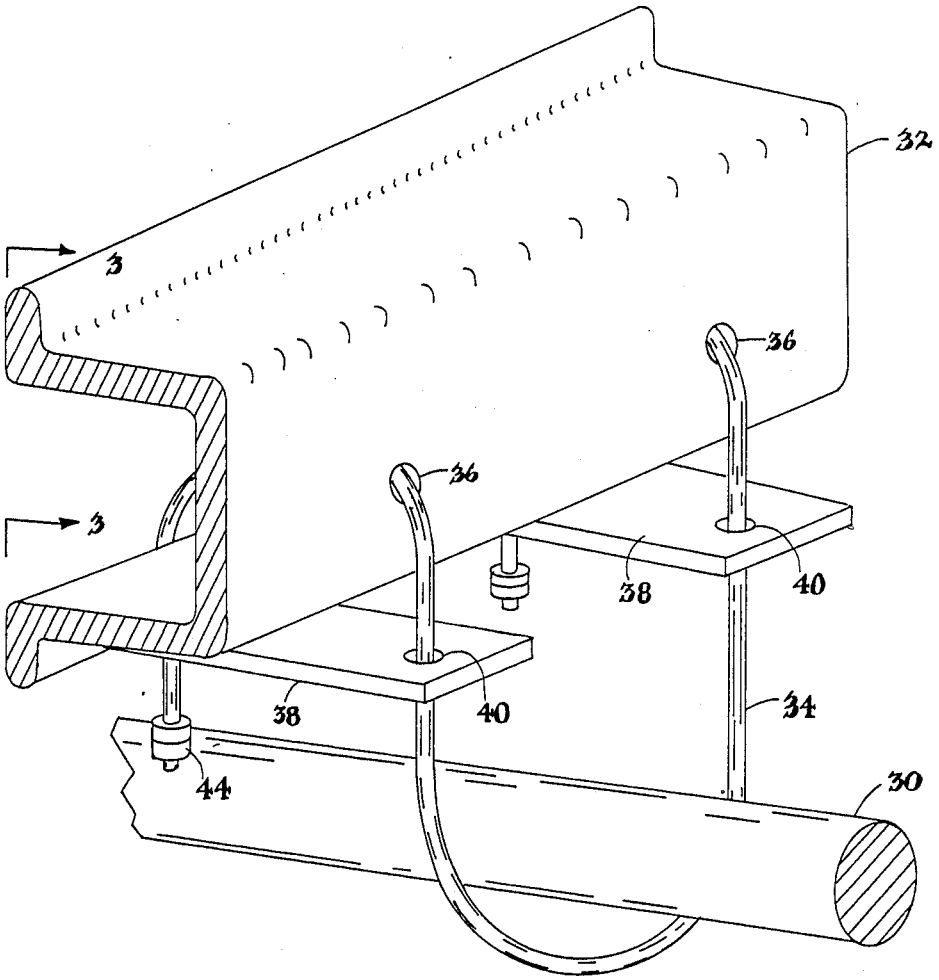
FIG. 2 is a perspective view of a portion of a brake beam and the bottom rod safety guard of the present invention.
Figure 3:
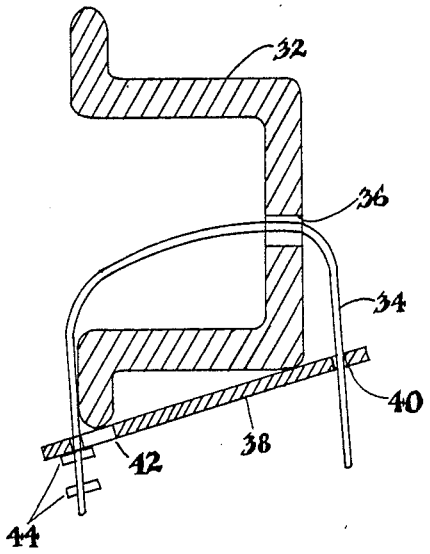
FIG. 3 is a sectional view along line 3—3 of FIG. 2.
Figure 4:
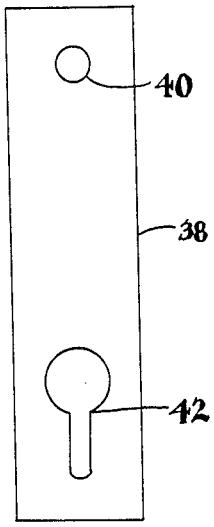
FIG. 4 is a plan view of the connector plate shown in FIGS. 2 and 3.

The bottom rod safety guard of the present invention is shown in FIGS. 2, 3 and 4, wherein the bottom rod 30 is shown in relationship with the channel shaped brake beam 32.

A length of resilient wire rope cable 34 is provided so as to depend from the brake beam 32 in a loop around the bottom rod 30. Rather than extending entirely around the brake beam or being bolted thereto, the ends of the cable are looped through the openings 36 in the beam 32 which normally receive bolts in a conventional application.

An apertured connector plate 38 is employed to provide releaseable retention of each end of the cable. The plate has a circular opening 40 at one end which is only slightly larger than the diameter of the cable. The other end of the plate has a slotted keyhole opening 42, with a relatively narrow slot nearer said other end and extending to an enlarged opening toward the central portion of the plate.

The end of the cable 34 is first passed through the small aperture 40 and the free end is provided with an enlarged collar 44, which may be swagged or otherwise secured to the cable. In order to provide a total length adjustment, a plurality of spaced collars may be provided near one or both ends of the cable as shown most clearly in FIG. 3.

In order to install the safety guard, the end of the cable is passed up and through one opening 36 in the brake beam 32, and the end is extended downwardly and is inserted into the enlarged portion of the keyhole opening 42, whereupon the cable is released, causing the end to enter into the narrow portion of the opening in latching engagement, with the connector plate 38 extending across the width of the bottom of the brake beam 32 as shown. Thus, the connector or latching means 38 provides a connection between a standing part and the end of a cable.

The arrangement is highly reliable for several reasons. The inherent springiness or resiliency of the cable tends to cause the looped portion of the free end to expand, causing the terminal to be urged into the narrow portion of the keyhole opening 42. Also, as shown, the distance between the small opening 40 at one end of the plate and the end of the slotted opening 42 is approximately equal to, or only slightly greater than the width of the beam, which prevents the enlarged end of the cable from moving inward and becoming disengaged.

The other end of the cable is inserted through the other bolt hole in the brake beam 32 and is releaseably secured in an identical fashion by an apertured connector plate as shown in FIG. 2. When installation is complete, the cable defines a pair of parallel loops through the beam and a downwardly extending intermediate perpendicular loop which extends around the bottom rod 30 and is normally spaced therefrom. The degree of downward extension of the intermediate safety loop may be adjusted by adjustments to the cable length as aforesaid.

I claim:

1. In a bottom rod safety guard for the brake rigging of a railway vehicle wherein the safety guard is in the form of a flexible resilient cable and is adapted to be supported from a brake beam and extend downwardly around a rod of said brake rigging, the improvement comprising a pair of connector members each having a first opening at one end slightly larger than the diameter of the cable and a second keyhole opening at the other end, with an enlarged portion of the keyhole opening being located toward a central portion of each connector member, first and second laterally spaced openings through the brake beam above said rod, said cable having an intermediate portion extending around said brake rod, the ends of the cable each having an enlarged terminus with said cable extending from said intermediate portion, through the first opening of the respective connector plates, through the respective first and second openings through the brake beam, and thence into latching engagement with the keyhole opening of the respective connector members.

2. The improvement of claim 1 wherein one end of said cable has a plurality of spaced enlarged terminii to allow adjustment of the length of the cable.

* * * * *